US006200719B1

(12) United States Patent
Kuroda

(10) Patent No.: US 6,200,719 B1
(45) Date of Patent: Mar. 13, 2001

(54) TONER, METHOD OF PRODUCING THE TONER, IMAGE FORMATION METHOD USING THE TONER, AND TONER CONTAINER

(75) Inventor: Noboru Kuroda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/545,329

(22) Filed: Apr. 7, 2000

(30) Foreign Application Priority Data

Apr. 8, 1999 (JP) ..... 11-100822

(51) Int. Cl.[7] ..... G03G 9/097; G03G 13/22; G03G 15/08

(52) U.S. Cl. ..... 430/110; 430/111; 430/124; 430/137; 399/252

(58) Field of Search ..... 430/110, 111, 430/124, 137; 399/252

(56) References Cited

U.S. PATENT DOCUMENTS 4,985,327 * 1/1991 Sakashita et al. ..... 430/110
5,155,532 * 10/1992 Sakurada et al. ..... 430/111
5,310,615 * 5/1994 Tanikawa ..... 430/110
5,470,687 * 11/1995 Mayama et al. ..... 430/137
5,482,808 * 1/1996 Kondo et al. ..... 430/111
5,958,642 * 9/1999 Takagi et al. ..... 430/110
5,985,502 * 11/1999 Ayaki et al. ..... 430/137
6,015,647 * 1/2000 Ugai et al. ..... 430/111

* cited by examiner

*Primary Examiner*—Roland Martin
(74) *Attorney, Agent, or Firm*—Oblon, Spivak, McClelland, Maier & Neustadt, P.C.

(57) ABSTRACT

A toner containing toner particles has a particular weight-average particle diameter, containing therein toner particles with another particle diameter in a predetermined number percentage of the number of the toner particles. A releasing agent contained in the toner particles has a particular endotherm ratio (Q/q), that is measured, using a differential scanning calorimeter (DSC), wherein q is the endotherm ($\mu$V·min/mg) of the releasing agent contained in predetermined classified and sampled toner particles, assessed per unit amount of the sampled toner particles, and Q is the endotherm ($\mu$V·min/mg) of the releasing agent contained in the toner particles of the toner in its entirety, assessed per unit amount of the toner particles. A method of producing the toner, and a method of forming images, using the toner, and a toner container or cartridge containing therein the toner are disclosed.

30 Claims, 2 Drawing Sheets

TONER, METHOD OF PRODUCING THE TONER, IMAGE FORMATION METHOD USING THE TONER, AND TONER CONTAINER

BACKGROUND OF THE INVENTION

1. Field of the Invention

The present invention relates to a toner for developing latent electrostatic images to toner images, which toner has excellent anti-offset performance, fluidity and durability, a method for forming toner images using the toner, a method for producing the toner, and a toner container for containing therein the toner.

2. Discussion of Background

In electrophotography, a latent electrostatic image is formed on a photoconductor comprising a photo-conductive material, using various means, and the formed electrostatic image is then developed with a toner to a visible toner image, and when necessary, the developed visible toner image is then transferred to a sheet of paper or the like, and fixed thereto with the application of heat and/or pressure thereto, or using a vapor of a solvent, whereby a hard copy can be obtained.

As methods for developing the electrostatic image to the visible image, using the toner, there are known, for instance, magnetic brush development method, cascade development method, and powder cloud development method. In any of these development methods, the step of fixing the toner image to a transfer sheet is a very important step. In particular, when the toner image is thermally fixed, using heat rollers, the toner image in a fused state comes into contact with the surface of the heat rollers, so that a phenomenon that the toner image adheres to the surface of the heat rollers and is transferred thereto, that is, a so-called offset phenomenon, may take place. It is required that such offset phenomenon should be prevented from occurring.

Conventionally, in order to prevent the occurrence of the offset phenomenon, the surface of an image fixing roller is made of a material having excellent releasability with respect to the toner, such as silicone rubber or fluorine-based resin.

Furthermore, conventionally, in order to prevent the occurrence of the offset phenomenon more effectively, and also to prevent the fatigue of the surface of the image fixing roller, the surface of the image fixing roller is covered or coated with a thin layer of a liquid which has high releasability with respect to the toner, such as silicone oil or a fluorine-based oil, which may be referred to as the offset preventing liquid.

The above-mentioned method is extremely effective for preventing the occurrence of the offset phenomenon, but has a problem that an apparatus for supplying the offset preventing liquid to the image fixing roller is necessary, which makes the image fixing apparatus complicated in mechanism. Furthermore, the step of coating the surface of the image fixing roller with the oil has the risk of bringing about the problems that the surface layers of the image fixing roller are separated and accordingly the life of the image fixing roller is significantly shortened while in use.

Instead of using such an oil supplying apparatus, there has been proposed a method of supplying an offset preventing liquid from toner particles themselves in the course of the image fixing step with the application of heat and/or pressure thereto. More specifically, a releasing agent such as a low-molecular-weight polyethylene, or a low-molecular-weight polypropylene, is added to the toner particles and is caused to ooze from the toner particles at the image fixing step while heat and/or pressure is applied thereto as disclosed, for instance, in Japanese Laid-Open Patent Application 60-230663 and Japanese Laid-Open Patent Application 1-234858.

Such a toner that includes the releasing agent in the toner particles thereof is generally produced by uniformly mixing a binder resin, a coloring agent and the releasing agent, each in a powder-like state, fusing and kneading the mixture, pulverizing the kneaded mixture to prepare a pulverized material and classifying the pulverized material.

However, generally the releasing agent has a lower molecular weight and a less hardness than the binder resin has, so that at the above-mentioned pulverizing step, the pulverizing of the kneaded mixture takes place selectively either inside the releasing agent or at the interface between the releasing agent and the binder resin. As a result, the releasing agent tends to be exposed at the surface of the toner particles. The larger the particle size of the releasing agent in the kneaded mixture of the toner, the more conspicuously the above-mentioned tendency is developed due to the non-uniformity in the mechanical strength of the components in the kneaded mixture, while the smaller the particle size of the releasing agent in the kneaded mixture of the toner, the less the tendency is developed due to the increased uniformity in the mechanical strength of the components in the kneaded mixture. Such a releasing agent tends to be subjected to excessive pulverizing, so that that the particle size of the releasing agent tends to be more considerably decreased than that of the binder resin.

It is known that as the amount of the releasing agent exposed on the surface of the toner particles is increased, the releasing agent is released from the surface of the toner particles and adheres to the surface of carrier particles or a charging member, so that a so-called spent phenomenon takes place by which the charging performance of the carrier particles and that of the charging member are significantly lowered, as a result, the durability of the toner is markedly lowered.

It is also known that the presence of the above-mentioned releasing agent within the toner impairs the fluidity of the toner and/or the transfer performance of the toner to a transfer sheet.

The pulverizing of the toner particles at the interface between the binder resin and the releasing agent takes place not only in the course of the production of the toner, but also within a development unit in the course of the stirring of the toner. When such pulverizing takes place, the toner aggregates or the fluidity of the toner is lowered, so that proper development and image transfer cannot be carried out and image quality obtained is lowered.

In order to solve the above problem, the following proposals have been made, in which the state of the added releasing agent in the toner is controlled:

For example, in Japanese Laid-Open Patent Application 3-243956, there is proposed the use of a toner having a 200 to 5000 Å average lattice length of a primary peak of a small angle X-ray scattering (SAXS); in Japanese Laid-Open Patent Application 3-296067, there is proposed a toner at a cross section of which there are formed island-sea structures composed of a binder polymer and polypropylene, with a maximum diameter in a major axis of island portions formed by the polypropylene being in a range of 200 to 3000 Å, and an average interval among the islands being 1 $\mu$m or less; and in Japanese Laid-Open Patent Application 5-45925, there is proposed a toner comprising toner particles on the surface of which there is deposited a releasing agent with a particle size of 100 to 5000 Å, having a fusing initiation temperature—fusing termination temperature difference of 50° C. or less, and a melting point of 60 to 180° C.

In order to maintain the development performance and abrasion resistance of a photoconductor, there is proposed in Japanese Laid-Open Patent Application 5-197199 a toner on the surface of which there are dispersed polyolefin particles with a particle size of 0.01 to 0.5 μm in an amount of 2 to 20%; in Japanese Laid-Open Patent Application 7-301951 a toner comprising a binder resin and a releasing agent with an SP value difference thereof being 1.5 or less; and in Japanese Laid-Open Patent Application 7-271095 a toner comprising a releasing agent with a crystallization degree in a range of 40 to 60% when the releasing agent is in the toner.

However, in any of the above prior art, the average values with respect to the overall characteristics of the toners are defined, but none of the prior art analyzes the state of the releasing agent in the toner particles with a smaller particle size than the average particle size of the toner particles, which smaller toner particles are in the range of 4 μm or less, and cause problems mainly in the fluidity of the toner and also cause the spent phenomenon. As a matter of course, problems in connection with the fluidity of the toner and the spent phenomenon thereof have not sufficiently been solved by the prior art.

Japanese Laid-Open Patent Application 10-69125 discloses a toner for electrophotography comprising toner particles, each toner particle comprising a binder resin, a coloring agent, and a wax which serves as a releasing agent. In this reference, the content of the releasing agent is defined by the ratio of the content (w) of the wax in the toner particles with a volume mean diameter of 3 μm to the content (W) of the wax in the entire toner particles of the toner with a volume mean diameter of 8 to 12 μm as being 1.00 to 1.20, that is, w/W=1.00 to 1.20. However, this reference neither teaches nor suggests anything about the state of the releasing agent in the toner particles with the particle size in the range of 4 μm or less, which mainly cause the problems with respect to the fluidity of the toner and also with respect to the spent phenomenon. Accordingly the problems are not effectively solved by the invention disclosed in this reference.

This reference does not specifically describe how to produce the toner, and the toners disclosed in the examples thereof cannot be produced even by the methods described in the examples.

SUMMARY OF THE INVENTION

It is therefore a first object of the present invention to provide a toner which has excellent fluidity and durability, with excellent anti-offset performance, free of the spent phenomenon, from which the problems of conventional toner comprising toner particles including a releasing agent have been eliminated.

A second object of the present invention is to provide a toner container containing therein the above-mentioned toner.

A third object of the present invention is to provide a toner cartridge containing therein the above-mentioned toner.

A fourth object of the present invention is to provide an image formation method for forming a toner image.

A fifth object of the present invention is to provide a method for producing the above-mentioned toner.

The first object of the present invention can be achieved by a toner which comprises toner particles, each toner particle comprising a binder resin, a coloring agent and a releasing agent, wherein the toner particles have a weight-average particle diameter of 5 to 12 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.77, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles.

The first object of the present invention can also be achieved by a toner comprising toner particles, each toner particle comprising a binder resin, a coloring agent and a releasing agent, wherein the toner particles have a weight-average particle diameter of 5 to 8 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.83, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles.

In the above-mentioned toners, it is preferable that the releasing agent be in an amount of 3 to 8 wt. % of the entire weight of the toner.

In the above-mentioned toners, it is preferable that the releasing agent have a melting point of 65° C. to 120° C.

In the above-mentioned toners, it is preferable that the releasing agent have a maximum endothermic peak in a range of 50° C. to 95° C. in a DSC endothermic curve of the releasing agent.

In the above-mentioned toners, it is preferable that the releasing agent have a melt viscosity of 0.04 Pa·s to 0.12 Pa·s at a flow initiation temperature of the binder resin.

In the above-mentioned toners, it is preferable that the releasing agent and the binder resin differ in terms of the value of SP (solubility parameter) thereof by a value of 1.0 to 3.5, more preferably by a value of 1.3 to 2.7.

In the above-mentioned toners, it is preferable that the releasing agent comprise carnauba wax.

In the above-mentioned toners, it is preferable that the binder resin comprise a resin selected from the group consisting of a polyester resin with a SP value of 11.0 or less and a polyol resin with a SP value of 11.0 or less.

The above-mentioned toners may further comprise a carrier, thereby each constituting a two-component type toner.

The second object of the present invention can be achieved by a toner container containing therein any of the above-mentioned toners.

The third object of the present invention can be achieved by a toner cartridge comprising a toner container portion and a development portion, containing therein any of the above-mentioned toners.

The fourth object of the present invention can be achieved by an image formation method for forming a toner image, comprising the steps of:

forming a latent electrostatic image on a latent electrostatic image bearing member, developing the latent electrostatic image with any of the above-mentioned toners to form a toner image on the latent electrostatic image bearing member, transferring the toner image from the latent electrostatic image bearing member to an image transfer sheet, and fixing the toner image to the image transfer sheet, using a contact type heat application roller free of oil application function, wherein the toner used is any of the above-mentioned toners.

The fifth object of the present invention can be achieved by a method for producing a toner which comprises toner particles, each toner particle comprising a binder resin, a coloring agent and a releasing agent, wherein the toner particles have a weight-average particle diameter of 5 to 12 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.77, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles, comprising the steps of:

mixing the binder resin, the coloring agent and the releasing agent, each in a powder state, fusing and kneading the binder resin, the coloring agent, and the releasing agent to prepare a kneaded material, pulverizing the kneaded material to prepare a pulverized material, and classifying the pulverized material to prepare the toner with a predetermined particle size distribution, wherein the temperature of the kneaded material at an outlet therefor in the fusing and kneading step is set at a temperature in a range of the melting point of the releasing agent to the temperature of 30° C. or less above a flow initiation temperature of the binder resin, and a specific energy of 0.1 kWH/kg or more is applied to the kneaded material.

The fifth object of the present invention can also be achieved by a method for producing a toner which comprises toner particles, each toner particle comprising a binder resin, a coloring agent and a releasing agent, wherein the toner particles have a weight-average particle diameter of 5 to 12 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.77, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles, comprising the steps of:

mixing the binder resin, the coloring agent and the releasing agent, each in a powder state, fusing and kneading the binder resin, the coloring agent, and the releasing agent to prepare a kneaded material, pulverizing the kneaded material to prepare a pulverized material, and classifying the pulverized material to prepare the toner with a predetermined particle size distribution, wherein the temperature of the kneaded material at an outlet therefor in the fusing and kneading step is set at a temperature in a range of the melting point of the releasing agent to the temperature of 20° C. or less above a flow initiation temperature of the binder resin, and a specific energy of 0.2 kWH/kg or more is applied to the kneaded material.

The fifth object of the present invention can also be achieved by a method for producing a toner which comprises toner particles, each toner particle comprising a binder resin, a coloring agent and a releasing agent, wherein the toner particles have a weight-average particle diameter of 5 to 8 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.83, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles, comprising the steps of:

mixing the binder resin, the coloring agent and the releasing agent, each in a powder state, fusing and kneading the binder resin, the coloring agent, and the releasing agent to prepare a kneaded material, pulverizing the kneaded material to prepare a pulverized material, and classifying the pulverized material to prepare the toner with a predetermined particle size distribution, wherein the temperature of the kneaded material at an outlet therefor in the fusing and kneading step is set at a temperature in a range of the melting point of the releasing agent to the temperature of 30° C. or less above a flow initiation temperature of the binder resin, and a specific energy of 0.1 kWH/kg or more is applied to the kneaded material.

The fifth object of the present invention can also be achieved by a method for producing a toner which comprises toner particles, each toner particle comprising a binder resin, a coloring agent and a releasing agent, wherein the toner particles have a weight-average particle diameter of 5 to 8 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.83, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles, comprising the steps of:

mixing the binder resin, the coloring agent and the releasing agent, each in a powder state, fusing and kneading the binder resin, the coloring agent, and the releasing agent to prepare a kneaded material, pulverizing the kneaded material to prepare a pulverized material, and classifying the pulverized material to prepare the toner with a predetermined particle size distribution, wherein the temperature of the kneaded material at an outlet therefor in the fusing and kneading step is set at a temperature in a range of the melting point of the releasing agent to the temperature of 20° C. or less above a flow initiation temperature of the binder resin, and a specific energy of 0.2 kWH/kg or more is applied to the kneaded material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
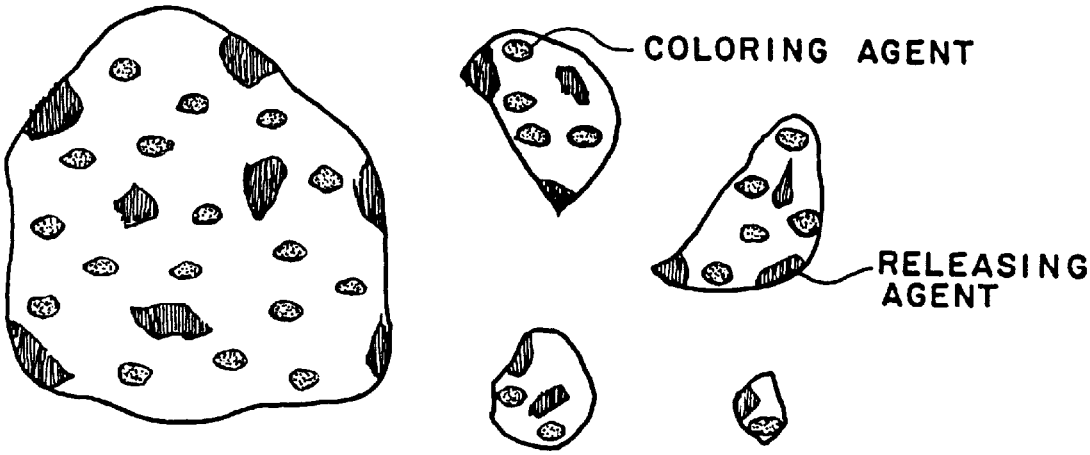
FIG. 1 is a schematic illustration of toner particles of a toner of the present invention.
Figure 2:
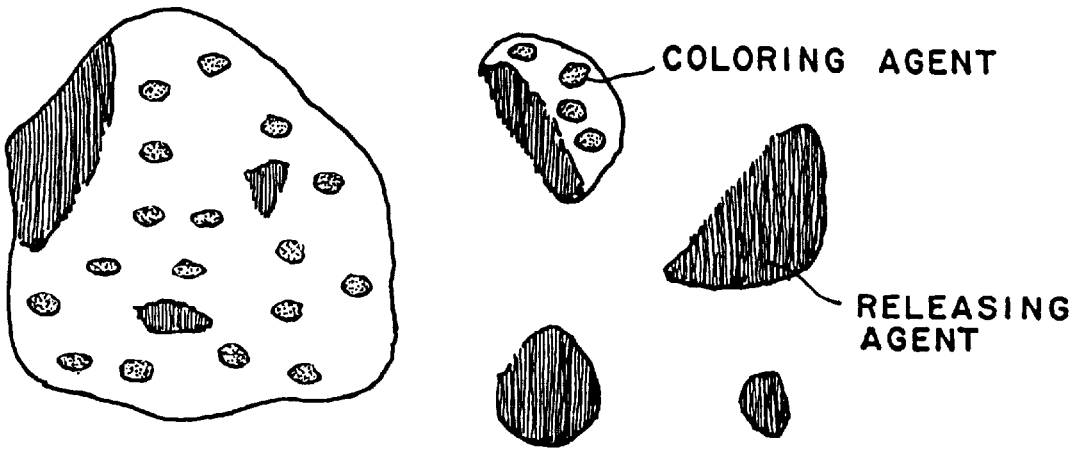
FIG. 2 is a schematic illustration of toner particles of a conventional toner.

The toner of the present invention has such a structure that comprises a coloring agent and a releasing agent which are dispersed in a binder resin as shown in FIG. 1.

More specifically, the toner of the present invention comprises toner particles, each toner particle comprising a binder resin, a coloring agent and a releasing agent, wherein the toner particles have a weight-average particle diameter of 5 to 12 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.77, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles.

The toner of the present invention may also comprise toner particles, each toner particle comprising a binder resin, a coloring agent and a releasing agent, wherein the toner particles have a weight-average particle diameter of 5 to 8 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.83, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles.

The releasing agent has a lower molecular weight and a less hardness than the binder resin has, so that at the pulverizing step for the preparation of the toner of the present invention, the kneaded and dried toner composition is apt to be crushed up and pulverized either at the inside of the releasing agent or at the interface between the releasing agent and the binder resin, or both at the inside of the releasing agent and at the interface between the releasing agent and the binder resin.

Therefore, when the releasing agent is not dispersed uniformly in the toner composition, the content of the releasing agent contained in the pulverized toner particles with a smaller particle diameter than the average particle diameter of the toner particles, per unit amount of the toner particles, is greater than the content of the releasing agent contained in the pulverized toner particles with the average particle diameter. The more uniform the dispersion of the releasing agent in the toner composition, the closer to 1 the value of the above-mentioned endotherm ratio (Q/q), and accordingly the more uniform the content of the releasing agent in each toner particle.

The fluidity and durability of the toner largely depend upon the state of the releasing agent dispersed in each toner particle. In the case of toner particles having a relatively small particle diameter, for example, a particle diameter of 4 μm or less, and a relatively large specific surface area, the state of the releasing agent dispersed in each toner particle is the main factor that controls the fluidity and durability of the toner.

In other words, when the toner composition in which the releasing agent is not dispersed uniformly is pulverized, the releasing agent tends to be contained in a larger amount in smaller toner particles, so that a larger amount of the releasing agent tends to be exposed on the surface of the toner particles with smaller particle diameters. The exposed releasing agent is more adhesive than the binder resin, so that the fluidity of the toner comprising such toner particles is impaired and the spent phenomenon is apt to take place, with the toner particles adhering to the carrier placed in a development unit and/or to a latent image bearing member such as a photoconductor.

In the toner of the present invention, it is preferable that the releasing agent be in an amount of 3 to 8 wt. % of the entire weight of the toner.

According to the present invention, in producing the toner of the present invention, a specific energy of 0.1 kWH/kg is applied to a kneaded material for the preparation of the toner at the step of f using and kneading the binder resin, the coloring agent and the releasing agent. This specific energy is not applied to the kneaded material in order to fuse the binder resin, but is applied to the kneaded material to effectively promote the dispersion of the releasing agent in the kneaded material. By the application of the specific energy to the kneaded material in the above-mentioned manner, appropriate shearing force can be effectively applied to the resin, and the kneaded material can be maintained at an appropriate temperature, which are both extremely important for producing the toner of the present invention.

As mentioned above, the toner of the present invention comprises toner particles, each toner particle comprising the binder resin, the coloring agent and the releasing agent, wherein the toner particles have a weight-average particle diameter of 5 to 12 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.77, that is measured, using a differential scanning calorimeter (DSC), by classifying and sampling toner particles with a weight-average particle diameter of 4 μm from the toner, wherein q is the endotherm (μV·min/mg) of the releasing agent contained in the sampled toner particles, assessed per unit amount of the sampled toner particles, and Q is the endotherm (μV·min/mg) of the releasing agent contained in the toner particles of the toner in its entirety, assessed per unit amount of the toner particles.

It is preferable that in the above toner, the releasing agent have an endotherm ratio (Q/q) of 0.98 to 0.83.

Even when the toner particles with a weight-average particle diameter of 3 μm is classified and sampled from the above toner, it is also preferable that the releasing agent have an endotherm ratio (Q1/q1) of 0.98 to 0.77, more preferably an endotherm ratio (Q1/q1) of 0.98 to 0.83.

The toner of the present invention may also comprise toner particles, each toner particle comprising the binder resin, the coloring agent and the releasing agent, wherein the toner particles have a weight-average particle diameter of 5 to 8 μm, containing therein toner particles with a particle diameter of 4 μm or less in an amount of 35% or less in terms of the percentage of the number of toner particles in the toner particles, and the releasing agent has an endotherm ratio (Q/q) of 0.98 to 0.83.

When the releasing agent and the binder resin are completely uniformly dispersed in the toner composition, the value of the endotherm ratio (Q/q) is equal to 1.00 (Q/q= 1.00). The less uniform the dispersion of the releasing agent in the toner composition, the smaller the value of the endotherm ratio (Q/q).

More specifically, when the value of the endotherm ratio (Q/q) is less than 0.77, the dispersion of the releasing agent is so poor that the content of the releasing agent in the toner particles with a particle diameter of 4 μm is increased and the releasing agent is more exposed on the surface of the toner particles. The result is that the fluidity of the toner is impaired and the durability of the toner is decreased due to the more frequent occurrence of the spent phenomenon.

It is preferable that the toner of the present invention have a weight-average particle size in the range of 5 to 12 μm, preferably in the range of 5 to 8 μm.

When the weight-average particle size of the toner is less than 5 μm, there easily occur the problems that the inside of an image formation apparatus is contaminated due to the scattering of the toner particles while in use for an extended period of time, the image density decreases at low humidity, and a photoconductor cannot be cleaned properly. Furthermore, the productivity of the toner is reduced and accordingly the cost of the toner is increased.

When the weight-average particle size exceeds 12 μm, the percentage of the presence of toner particles with a particle diameter of about 4 μm is reduced so that the fluidity of the toner will hardly be impaired, even though the dispersion of the releasing agent becomes poor more or less. However, the toner particles tend to be scattered and deposited on a non-image area (background area), thereby lowering the image quality.

In the toner of the present invention, it is preferable that toner particles with a particle diameter of 4 μm or less be contained in an amount of 35% or less in terms of the percentage of the number of toner particles in the total toner particles in the toner. By containing the toner particles with the diameter of 4 μm or less in the above-mentioned amount, which have a large specific area and have an effect on the fluidity of the toner, the fluidity and the durability of the toner of the present invention can be improved, while achieving the effect of improving the dispersion of the releasing agent in the toner.

As mentioned above, in the toner of the present invention, it is preferable that the releasing agent be contained in an amount of 3 to 8 wt. % of the entire weight of the toner. When the content of the releasing agent is less than 3 wt. % of the entire weight of the toner, sufficient releasability to improve the anti-offset performance is difficult to obtain, while when the content of the releasing agent is more than 8 wt. % of the entire weight of the toner, it is difficult to disperse the releasing agent to such extent the releasing agent exhibits its releasing function as desired, and the fluidity of the toner becomes impaired due to an increase in the total amount of the releasing agent.

In the toner of the present invention, it is preferable that the releasing agent: have a melting point of 65° C. to 120° C., more preferably a melting point of 65° C. to 90° C.

Furthermore, in the toner of the present invention, it is preferable that the releasing agent have a maximum endothermic peak in a range of 50° C. to 95° C. in a DSC endothermic curve of the releasing agent.

When a releasing agent having a melting point of lower than 65° C., or a maximum endothermic peak of lower than 50° C. is used in the toner, the toner has the problem that the toner is softened to aggregate while preserved or placed in a copying machine.

When a releasing agent having a melting point of higher than 120° C., or a maximum endothermic peak of higher than 95° C. is used in the toner, the releasing agent does not properly ooze from the toner particles at the image fixing step and does not perform its releasing function effectively.

In the toner of the present invention, it is preferable that the releasing agent have a melt viscosity of 0.04 Pa·s to 0.12 Pa·s, more preferably 0.05 Pa·s to 0.10 Pa·s, at a flow initiation temperature of the binder resin. When the melt viscosity of the releasing agent is less than 0.04 Pa·s, the viscosity of the kneaded material for the preparation of the toner in a kneading apparatus is so low that it is difficult to apply shearing force to the kneaded material and the releasing agent cannot be effectively dispersed in the toner particles. When the melt viscosity of the releasing agent is more than 0.12 Pa·s, the releasing agent does not properly ooze from the toner particles at the image fixing step and does not perform its releasing function effectively.

In the toner of the present invention, it is preferable that the releasing agent and the binder resin differ in terms of the value of SP (solubility parameter) thereof by a value of 1.0 to 3.5, more preferably by a value of 1.3 to 2.7. When the difference in the value of SP is less than 1.0, the releasing agent and the binder resin become soluble in each other, so that the releasing agent cannot exist in the form of domains in the toner particles and therefore does not perform its releasing function. When the difference in the value of SP is more than 3.5, the mutual wettability of the releasing agent and the binder resin is so low that the releasing agent cannot be finely dispersed in the toner particles.

It is preferable that the releasing agent comprise or be carnauba wax.

In the toner of the present invention, it is preferable that the binder resin to be used in combination with the releasing agent comprise or be a resin selected from the group consisting of a polyester resin with a SP value of 11.0 or less and a polyol resin with a SP value of 11.0 or less.

The toner of the present invention may further comprise a carrier, thereby constituting a two-component type toner, which is improved with respect to the charging stability and the life due to the reduction of the spent phenomenon caused by the deposition of the releasing agent on the carrier particles of the carrier.

Furthermore, the fluidity of the two-component toner is so good that the toner can be packed with high density, and even when the toner is packed with high density in a toner container such as a toner bottle or a toner cartridge, the toner can be easily discharged from the toner container.

Furthermore, even when the toner of the present invention is used as one-component toner, the toner can be packed with high density and the highly packed one-component toner in the toner container can be easily discharged therefrom, which is advantageous, particularly when used in a compact development section.

In the step of fusing and kneading the binder resin, the coloring agent, and the releasing agent to prepare a kneaded material for producing the toner of the present invention, it is preferable that the temperature of the kneaded material at an outlet therefor be set at a temperature in a range of the melting point of the releasing agent to the temperature of 30° C. or less above a flow initiation temperature of the binder resin, with the application of a specific energy of 0.1 kWH/kg or more to the kneaded material.

It is more preferable that the temperature of the kneaded material at the outlet therefor be set at a temperature in a range of the melting point of the releasing agent to the temperature of 20° C. or less above a flow initiation temperature of the binder resin, with the application of a specific energy of 0.2 kWH/kg or more to the kneaded material.

When the applied specific energy is less than 0.1 kWH/kg, the shearing force applied to the kneaded material is too small to produce the toner of the present invention. However, it is not appropriate to apply excessive specific energy to the kneaded material in view of the productivity of the toner of the present invention. It is substantially preferable that a specific energy of 1.0 kWH/kg or less be applied to the kneaded material.

In order to use the energy effectively for dispersing the releasing agent, it is preferable that the viscosity of the kneaded material within a kneader therefore be maintained high. For this purpose, it is preferable that that the temperature of the kneaded material at an outlet therefor be set at a temperature in a range of the melting point of the releasing agent to the temperature of 30° C. or less above a flow initiation temperature of the binder resin, more preferably in a range of the melting point of the releasing agent to the temperature of 20° C. or less above a flow initiation temperature of the binder resin.

The specific energy can be defined and determined by the following formula:

Specific energy={(power at kneading)−(power at non-loading)}/(kneaded amount)

The endotherm ($\mu$V·min/mg) of the releasing agent is determined as follows by using a differential scanning calorimeter (DSC):

As the differential scanning calorimeter, DSC-7 made by PerkinElmer Inc., was employed. The amount of the used sample was in the range of 10 to 20 mg. The temperature elevation rate was 10° C./min.

Figure 3:
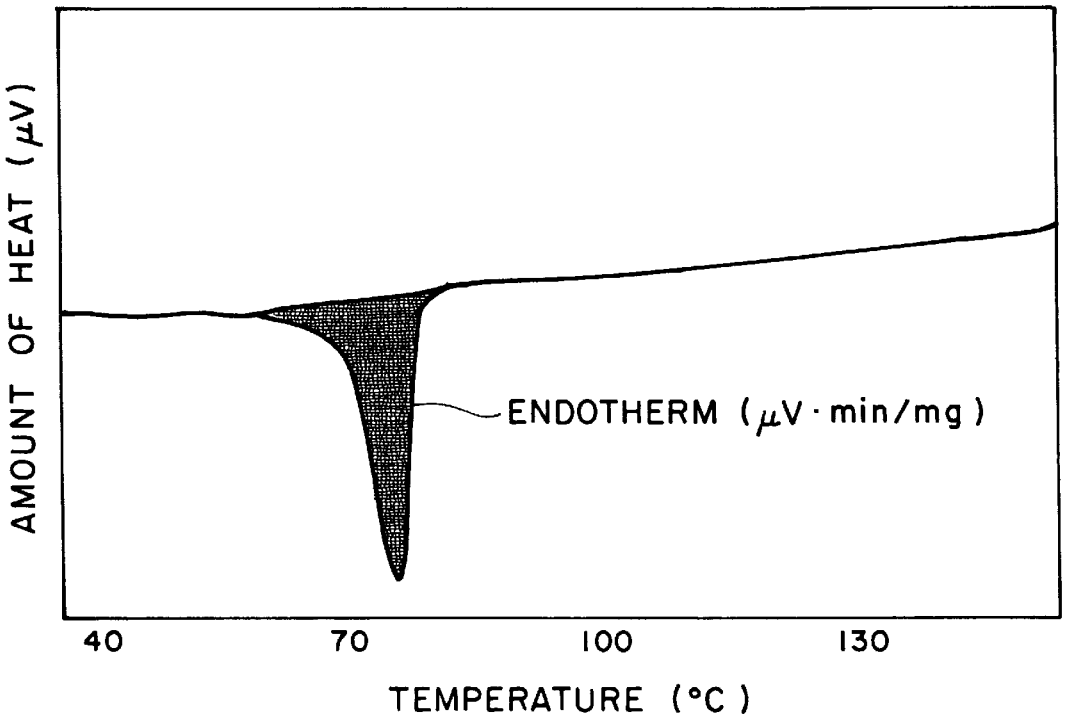
FIG. 3 is a diagram for determining the endotherm of a releasing agent based on an endothermic curve of the releasing agent obtained, using a differential scanning calorimeter (DSC).

Furthermore, in order to eliminate the endotherm due to the work hysteresis of the resin, the sample was pre-heated and fused at the temperature of 170° C. under the above-mentioned conditions and was then cooled. The endotherm ($\mu$V·min/mg) of the releasing agent was then measured. FIG. 3 shows a representative measurement data of the releasing agent.

Although various methods are available for determining toner's particle size distribution, in the present invention, a commercially available apparatus "Coulter Counter Model TA II" (Trademark), made by Coulter Electronics Ltd., was employed for determining the particle size distribution of the toner of the present invention. For outputting the measurement of the particle size distribution by number and that by volume, an output interface (Nikkaki Co., Ltd.) and a personal computer "PC9801", made by NEC Corporation are connected to the "Coulter Counter Model TA II".

As an electrolyte, a 1% aqueous solution of sodium chloride was prepared using a first class grade chemical of NaCl.

To 10 to 15 ml of the above prepared electrolyte, 0.1 to 5 ml of a surfactant serving as a dispersant, preferably alkylbenzene sulfonate, was added.

A sample (toner particles) in an amount of 2 to 20 mg was then added to the above electrolyte. The mixture was then subjected to ultrasonic dispersion for about 1 to 3 minutes in an ultrasonic dispersing apparatus.

The thus prepared sample dispersion was then added to 100 to 200 ml of an aqueous solution of sodium chloride separately prepared in a beaker so as to obtain a dispersion with a predetermined concentration of the sample dispersion.

By use of the above-mentioned "Coulter Counter Model TA II" provided with a 100 $\mu$m aperture, the particle distribution of toner particles with a particle size ranging from 2 to 40 $\mu$m in the above sample dispersion was measured. The volume distribution and the number distribution of the particles with a particle size ranging from 2 to 40 $\mu$m were calculated. From the volume particle distribution, the weight-average particle diameter (D4) of the sample was determined, in which the median in each channel was determined to be a representative value of each channel.

The melting point of the binder resin for use in the present invention was determined, using a commercially available flow testing instrument (Trademark "Capillary Rheometer Shimadzu Flowmeter CFT-500D" made by Shimadzu Corporation), under the conditions that a dies diameter was 0.5 mm, pressure was 10 kg/cm$^2$, temperature elevation rate was 3° C./min. The flow initiation temperature was regarded as the melting point. The measurement of the melting point of low-molecular weight material was conducted by use of a commercially available tester (Trademark "Rigaku Thermoflex TG8110" made by Rigaku Denki Company, Ltd.) with a temperature elevation rate of 10° C./min, and the melting point was determined from the main maximum peak in the endothermic curve obtained.

Melt viscosity was measured by use of a commercially available viscosity testing instrument (Trademark "Rheometrics Dynamic Spectrometer RDS-7700" made by Rheometrics Inc.) under the conditions that parallel disc plates with a diameter of 25 mm were employed as fixtures, frequency was set at 100 rad/sec, distortion was set at 5%, and stabilizing time was set at 5 min.

In the present invention, the term "the value of SP" or "SP value" refers to the solubility parameter.

The SP values of pigments and resins were approximately determined in view of the solubilities thereof in organic solvents with known SP values.

To the toner of the present invention, a fluidity-improvement agent for improving the fluidity of the toner can be added. As such a fluidity-improvement agent, inorganic finely-divided particles are preferable for use with the toner of the present invention. For the toner of the present invention, which comprises finely-divided toner particles with the releasing agent being present in the particular state therein, a small amount of inorganic finely-divided particles effectively work to significantly improve the fluidity and the durability of the toner.

Specific examples of the materials for the above-mentioned finely-divided particles are oxides of Si, Ti, Al, Mg, Ca, Sr, Ba, In, Ga, Ni, Mn, W, Fe, Co, Zn, Cr, Mo, Cu, Ag, V, and Zr, and composite oxides thereof.

Of these finely-divided particles of the oxides and the composite oxides, finely-divided particles of silicon dioxide, titanium dioxide and alumina are more preferably employed.

It is also effective to treat the surface of the finely-divided particles with a hydrophobic treatment agent or the like to change the properties of the surface of the finely-divided particles.

The following are representative examples of hydrophobic treatment agents; dimethyl dichlorosilane, trimehtylchlorosilane, methyl trichlorosilane, allyl dimethyl dichlorosilane, allyl phenyl dichlorosilane, benzyl dimethyl chlorosilane, bromomethyl dimethyl chlorosilane, α-chloroethyltrichlorosilane, p-chloroethyltrichlorosilane, chloromethyl dimethyl chlorosilane, chloromethyl trichlorosilane, p-chlorophenyltrichlorosilane, 3-chloropropyl trichlorosilane, 3-chloropropyl trimethoxysilane, vinyl triethoxysilane, vinyl methoxysilane, vinyl-tris(β-methoxyethoxy)silane, γ-methacryloxypropyltrimethoxysilane, vinyl triacetoxysilane, divinyl dichlorosilane, dimethyl vinyl chlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, didecenyldichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl trimethoxy-silane, hexamethyl disilazane, hexaethyl disilazane, diethyl tetramethyl disilazane, hexaphenyl disilazane, and hexatolyl disilazane. In addition, titanate based coupling agent and aluminum based coupling agent can also be employed.

It is preferable that the amount of the inorganic finely-divided particles be in the range of 0.1 to 2 wt. % of the entire weight of the toner. When the amount of inorganic finely-divided particles is less than 0.1 wt. %, aggregation of toner particles cannot be effectively prevented. When the amount of the inorganic finely-divided particles exceeds 2 wt. %, the toner particles tend to scatter between thin line images, the inside of the image forming apparatus tends to be stained with toner particles, and the photoconductor is easily damaged or abraded.

The toner of the present invention may further comprise other additives in a small amount as long as they have an adverse effect on the toner. For instance, there can be employed a lubricant such as finely-divided particles of Teflon, zinc stearate, and polyvinylidene fluoride; an abrasive such as finely-divided particles of cerium oxide, silicon carbide and strontium titanate; an electroconductivity imparting agent such as finely-divided particles of carbon black, zinc oxide and tin oxide; and an agent for improving development performance such as finely-divided white powders and black powders, each having a polarity opposite to that of the toner.

As the binder resins for use in the toner of the present, any binder resins used in the conventional toners are usable. A vinyl resin, a polyester resin, or a polyol resin is preferably employed as the binder resin. However, such resins that exhibit an SP value difference of less than 1.0, when used in combination with the releasing agent, are not preferable for use in the present invention. For example, when carnauba wax is used as the releasing agent, styrene-acrylic resin is not a preferable resin to used in combination with carnauba wax. Carnauba wax can be used in combination with other resins as long as the above-mentioned conditions with respect to the SP value difference are met.

Specific examples of the vinyl resin used as the binder resin for use in the toner include homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylethyl ether copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer; and poly(methyl methacrylate), poly(butyl methacrylate), polyvinyl chloride, and polyvinyl acetate.

The polyester resin serving as the binder resin for use in the present invention is prepared from a dihydroxy alcohol component (a) selected from the following group A and a dibasic acid component (b) selected from the following group B. Furthermore, a polyhydric alcohol having three or more hydroxyl groups, or a polycarboxylic acid having three or more carboxyl groups selected from the following group C may be added to the above-mentioned components (a) and (b).

Group A: ethylene glycol, triethylene glycol, 1,2-propylene glycol, 1,3-propylene glycol, 1,4-butanediol, neopentyl glycol, 1,4-butenediol, 1,4-bis(hydroxymethyl) cyclohexane, bisphenol A, hydrogenated bisphenol A, a reaction product of polyoxyethylene and bisphenol A, polyoxypropylene(2,2)-2,2'-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene(2,0)-2,2'-bis(4-hydroxyphenyl) propane.

Group B: maleic acid, fumaric acid, mesaconic acid, citraconic acid, itaconic acid, glutaconic acid, phthalic acid, isophthalic acid, terephthalic acid, cyclohexane-dicarboxylic acid, succinic acid, adipic acid, sebacic acid, malonic acid, linolenic acid; anhydrides of the above acids; and esters of the above acids and a lower alcohol.

Group C: polyhydric alcohols having three or more hydroxyl groups, such as glycerin, trimethylolpropane, and pentaerythritol; and polycarboxylic acids having three or more carboxyl groups, such as trimellitic acid and pyromellitic acid.

In the present invention, it is preferable to employ a polyol resin which is prepared by allowing the following components to react: (1) an epoxy resin; (2) an alkylene oxide adduct of a dihydric phenol or a glycidyl ether of the alkylene oxide adduct; (3) a compound having in the molecule thereof one active hydrogen atom which is capable of reacting with epoxy group; and (4) a compound having in the molecule thereof two or more active hydrogen atoms which are capable of reacting with epoxy group.

The above-mentioned resins may be used together with other resins, for example, epoxy resin, polyamide resin, urethane resin, phenolic resin, butyral resin, rosin, modified rosin, and terpene resin when necessary.

As the aforementioned epoxy resin for use in the present invention, a polycondensation product of a bisphenol such as bisphenol A or bisphenol F and epichlorohydrin is representative.

The coloring agent for use in the toner of the present invention includes a variety of pigments.

Examples of black pigments are carbon black, oil furnace black, channel black, lamp back, acetylene black, Azine dyes such as aniline black, metallic salt azo dyes, metallic oxides, and composite metallic oxides.

Examples of yellow pigments are Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake.

Examples of orange pigments are Molybdate Orange, Permanent Orange GTR, Pyrazolone Orange, Vulcan Orange, Indanthrene Brilliant Orange RK, Benzidine Orange G, and Indanthrene Brilliant Orange GK.

Examples of red pigments are red iron oxide, Cadmium Red, Permanent Red 4R, Lithol Red, Pyrazolone Red, Watchung Red Calcium Salt, Lake Red D, Brilliant Carmine 6B, cosine Lake, Rhodamine Lake B, Alizarine Lake, and Brilliant Carmine 3B.

Examples of purple pigments are Fast Violet B and Methyl Violet Lake.

Examples of blue pigments are Cobalt Blue, Alkali Blue, Victoria Blue Lake, Phthalocyanine Blue, metal-free Phthalocyanine Blue, Phthalocyanine Blue partially chlorinated, Fast Sky Blue and Indanthrene Blue BC.

Examples of green pigments are Chrome Green, chromium oxide, Pigment Green B, and Malachite Green Lake.

These pigments can be employed alone or in combination.

Further, any conventional dyes may be used as the coloring agents in the present invention.

Examples of the releasing agent for use in the present invention include natural waxes such as candelilla wax, carnauba wax, and rice wax; montan wax, paraffin wax, sazol wax, low-molecular-weight polyethylene, low-molecular-weigh polypropylene, and alkyl phosphate.

The releasing agent can be selected in accordance with the kind of binder resin to be used in the toner and the kind of material used in the surface portion of the image fixing roller. It is preferable that the melting point of the releasing agent for use in the present invention be in the range of 65° C. to 120° C., more preferably in the range of 65° C. to 90° C. When the melting point of the releasing agent is within the above-mentioned range, the blocking of toner particles can be prevented during the storage thereof, and the off-set phenomenon does not easily take place when the image fixing roller is in a low temperature region. In other words, when the melting point of the releasing agent is lower than 65° C., the blocking of toner particles tends to take place, while when the melting point of the releasing agent is higher than 120° C., the off-set phenomenon tends to take place even when the image fixing roller is in a low temperature region.

As the releasing agent for use in the toner of the present invention, carnauba wax is particularly preferable.

It is preferable that the toner of the present invention further comprise a charge control agent. The charge control agent may be incorporated in the toner particles (internal addition), or may be mixed with the toner particles (external addition). The charge control agent can appropriately control the charge quantity of the toner in such a manner as to be suitable for a development system employed.

Specific examples of positive charge control agents are nigrosine, quaternary ammonium salts, and imidazole metal complexes and salts thereof, which can be used alone or in combination; and specific examples of negative charge control agents are salicylic acid metal complexes and salts thereof, organic boron salts, and calixarene compounds.

The toner of the present invention may further comprise a carrier, thereby constituting a two-component toner, which may be referred to a two-component developer.

As the carrier for use in the two-component developer of the present invention, there can be used any materials which are used in conventional carriers. For example, magnetic powders such as iron powder, ferrite powder, nickel powder, and magnetite powder can be used as the carrier, and these magnetic powders may be surface-treated with a fluorine-containing resin, vinyl resin or silicone resin. Furthermore, magnetic-particles-dispersed resin particles, which are prepared by dispersing the magnetic powders in a resin, can also be employed as the carrier particles. It is preferable that that the magnetic carrier particles in the carrier have an average particle diameter in the range of 35 $\mu$m to 75 $\mu$m.

The toner of the present invention can be used in the form of a magnetic toner by containing a magnetic powder in the toner particles of the toner.

The toner of the present invention can be prepared, for example, by sufficiently mixing the above-mentioned binder resin, pigment or dye serving as the coloring agent, releasing agent, charge control agent, and other additives, in a mixer such as a Henschel mixer, and thoroughly kneading the mixture by a kneader.

As the kneader, for example, the following can be employed: a continuous double screw extruder such as a KTK type double screw extruder made by Kobe Steel, Ltd., a TEM type double screw extruder made by Toshiba Machine Co., Ltd., a PCM type double screw extruder made by Ikegai Tekko Co., a KEX type double screw extruder made by Kurimoto, Ltd.; a continuous single screw kneader, such as Continuous Kneader made by Buss Co., Ltd, and a thermal kneader such as a kneader made by KCK Co., Ltd.

In the kneading step, as a method of reducing the specific energy, the amount of the toner composition to be kneaded may be decreased, or the toner composition may be kneaded in a highly viscous state by decreasing the kneading temperature.

After the thus kneaded mixture is cooled, the mixture is coarsely crushed in a hammer mill, and thereafter finely pulverized by means of a pulverizer using jet air stream or a mechanical pulverizer, and then classified to obtain particles with a predetermined particle diameter using a rotary air classifier or a classifier utilizing a Coanda effect.

Then, the classified particles are sufficiently mixed with the above-mentioned finely-divided inorganic particles in a mixer such as a Henschel mixer, and the mixed particles are then caused to pass through a sieve with 250-mesh or more to remove coarse particles and aggregated particles therefrom. Thus, a toner according to the present invention is obtained.

Further, the thus obtained toner and the above-mentioned magnetic carrier may be mixed with a predetermined mixing ratio, so that a two-component toner of the present invention can be obtained.

Other features of this invention will become apparent in the course of the following description of exemplary embodiments, which are given for illustration of the invention and are not intended to be limiting thereof.

EXAMPLE 1

The following components were sufficiently mixed in a mixer.

| | Parts by Weight |
|---|---|
| Binder resin: polyester resin (Flow initiation temperature: 120° C.) | 100 |
| Coloring agent: carbon black | 10 |
| Charge control agent: zinc salicylate | 3 |
| Releasing agent: low-molecular-weight polyethylene (Melting point: 95° C., Melt viscosity: 0.05 Pa · s (at 120° C.), DSC endothermic peak temperature: 90° C. to 95° C.) | 5 |
| Approximate SP value difference between the binder resin and the releasing agent: 1.8 to 2.2 | |

The resultant mixture was fused and kneaded in the TEM type double screw extruder made by Toshiba Machine Co., Ltd., in such a manner that the specific energy at the time of kneading was set at 0.20 kWH/kg with the adjustment of the temperature of the extruder and the amount of the mixture to be kneaded, whereby a kneaded mixture (1) was obtained.

The kneaded mixture (1) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 22.6% in terms of the percentage of the number of the colored matrix particles, and had a weight-average particle diameter of 7.31 μm.

100 parts by weight of the colored matrix particles were mixed with 0.3 parts by weight of hydrophobic silica particles in a Henschel mixer, whereby a toner (1A) of the present invention was obtained.

The toner (1A) was then subjected to coarse classification, whereby a toner (1B) with a weight-average particle diameter of 4 μm was obtained.

The ratio of the endotherm of the releasing agent contained in the toner (1A) to the endotherm of the releasing agent contained in the toner (1B) by the DSC measurement.

The result was that the endotherm ratio (Q/q) of the releasing agent was 0.870, that is, Q/q=0.870.

In order to evaluate the fluidity of the toner (1A), the loose bulk density and the aggregation ratio of the toner (1A) were measured by use of a commercially available powder characteristics tester "Powder Tester PT-N" (Trademark), made by Hosokawa Micron Corporation.

The loose bulk density of the toner (1A) was determined by use of the "Powder Tester PT-N", by having the toner (1A) pass through a 250-mesh sieve, collecting the portion of the toner (1A) that passed through the 250-mesh sieve in a cup, and weighing the collected toner portion.

In order to determine the aggregation ratio of the toner (1A), the toner (1A) was classified, using 150 μm mesh-, 75 μm mesh-, and 45 μm mesh-sieves, with the application of vibrations thereto for 60 sec. Then, the aggregation was calculated in- accordance with the following formula:

$$\text{Aggregation ratio (\%)} = \left( \text{(remaining amount on 150}\mu\text{m sieve)} + 3 \times \frac{\text{(remaining amount on 75}\mu\text{m sieve)}}{5} + \frac{\text{(remaining amount on 45}\mu\text{m sieve)}}{5} \right) \times 50$$

Preparation of Two-Component Developer No. 1

2.5 parts by weight of the toner (1A) were mixed with 97.5 parts by weight of a carrier prepared by coating ferrite particles having an average particle diameter of 60 μm with a silicone resin, whereby a two-component developer No. 1 according to the present invention was prepared.

The thus obtained two-component developer No. 1 was set in a commercially available copying apparatus "imagio DA505" (Trademark), made by Ricoh Company, Ltd., and subjected to a running test of making 100,000 copies to evaluate the durability, the anti-offset performance, and the image quality obtained.

More specifically, the durability was evaluated by assessing a change in the charge quantity of the developer in the course of the start of the running test through the completion of making 100,000 copies. The change was found to be −0.9 μC/g, which was in a range free of practical problem.

Furthermore, the anti-offset performance was evaluated by measuring the hot off-set phenomenon occurrence temperature of the developer No. 1, at which hot off-set phenomenon occurred, with the image fixing temperature set in a range of 140° C. to 210° C. The result was that the hot off-set phenomenon occurrence temperature was 195° C., which was in a range free of practical problem.

The image quality was evaluated by checking the resolution of fine line images reproduced from a standard image evaluation test chart S-3, using a magnifying glass and rankings of 1 to 5, in which the larger the numerical value, the higher the resolution in the production of fine line images. The results of the evaluation are shown in TABLE 2.

EXAMPLE 2

The procedure for producing the toner (1A) in Example 1 was repeated in the same manner as in Example 1 except that the pulverized mixture for use in the toner (1A) was subjected to air classification, using the rotary air classifier in such a manner that there were obtained such colored matrix particles that contained therein colored particles with a particle diameter of 4 μm or less in an amount of 15.2% in terms of the percentage of the number of the colored matrix particles, and had a weight-average particle diameter of 7.54 μm, by changing the classifying conditions, whereby a toner (2A) was prepared.

The toner (2A) was then subjected to coarse classification, whereby a toner (2B) with a weight-average particle diameter of 4 μm was obtained.

The ratio of the endotherm of the releasing agent contained in the toner (2A) to the endotherm of the releasing agent contained in the toner (2B) by the DSC measurement.

The result was that the endotherm ratio (Q/q) of the releasing agent was 0.855, that is, Q/q=0.855.

In order to evaluate the fluidity of the toner (2A), the loose bulk density and the aggregation ratio of the toner (2A) were measured in the same manner as in Example 1. The results are shown in TABLE 2.

Preparation of Two-Component Developer No. 2

2.5 parts by weight of the toner (2A) were mixed with 97.5 parts by weight of a carrier prepared by coating ferrite particles having an average particle diameter of 60 μm with a silicone resin, whereby a two-component developer No. 2 according to the present invention was prepared.

The thus obtained two-component developer No. 2 was evaluated in the same manner as for the two-component developer No. 1 in Example 1. The results of the evaluation are shown in TABLE 2.

EXAMPLE 3

The procedure for producing the toner (1A) in Example 1 was repeated in the same manner as in Example 1 except that the pulverized mixture for use in the toner (1A) was subjected to air classification, using the rotary air classifier in such a manner that there were obtained such colored matrix particles that contained therein colored particles with a particle diameter of 4 μm or less in an amount of 8.3% in terms of the percentage of the number of the colored matrix particles, and had a weight-average particle diameter of 7.72 μm, by changing the classifying conditions, whereby a toner (3A) was prepared.

The toner (3A) was then subjected to coarse classification, whereby a toner (3B) with a weight-average particle diameter of 4 μm was obtained.

The ratio of the endotherm of the releasing agent contained in the toner (3A) to the endotherm of the releasing agent contained in the toner (3B) by the DSC measurement.

The result was that the endotherm ratio (Q/q) of the releasing agent was 0.833, that is, Q/q=0.833.

In order to evaluate the fluidity of the toner (3A), the loose bulk density and the aggregation ratio of the toner (3A) were measured in the same manner as in Example 1. The results are shown in TABLE 2.

Preparation of Two-Component Developer No. 3

2.5 parts by weight of the toner (3A) were mixed with 97.5 parts by weight of a carrier prepared by coating ferrite particles having an average particle diameter of 60 μm with a silicone resin, whereby a two-component developer No. 3 according to the present invention was prepared.

The thus obtained two-component developer No. 3 was evaluated in the same manner as for the two-component developer No. 1 in Example 1. The results of the evaluation are shown in TABLE 2.

EXAMPLE 4

A kneaded mixture (2) was prepared in the same manner as for the kneaded mixture (1) prepared in Example 1 except that the specific energy at the time of kneading was set at 0.32 kWH/kg with the adjustment of the temperature of the extruder and the amount of the mixture to be kneaded.

The kneaded mixture (2) was rolled and cooled, and then coarsely crushed by a cutter mill and finely pulverized by means of a pulverizer using jet air stream.

The pulverized mixture was then subjected to air classification, using a rotary air classifier, whereby there were obtained such colored matrix particles that contained therein colored particles with a particle diameter of 4 μm or less in an amount of 8.1% in terms of the percentage of the number of the colored matrix particles, and had a weight-average particle diameter of 7.50 μm.

100 parts by weight of the colored matrix particles were mixed with 0.3 parts by weight of hydrophobic silica particles in a Henschel mixer, whereby a toner (4A) of the present invention was obtained.

The toner (4A) was then subjected to coarse classification, whereby a toner (4B) with a weight-average particle diameter of 4 μm was obtained.

The ratio of the endotherm of the releasing agent contained in the toner (4A) to the endotherm of the releasing agent contained in the toner (4B) by the DSC measurement.

The result was that the endotherm ratio (Q/q) of the releasing agent was 0.917, that is, Q/q=0.917.

In order to evaluate the fluidity of the toner (4A), the loose bulk density and the aggregation ratio of the toner (4A) were measured in the same manner as in Example 1. The results are shown in TABLE 2.

Preparation of Two-Component Developer No. 4

2.5 parts by weight of the toner (4A) were mixed with 97.5 parts by weight of a carrier prepared by coating ferrite particles having an average particle diameter of 60 μm with a silicone resin, whereby a two-component developer No. 4 according to the present invention was prepared.

The thus obtained two-component developer No. 4 was evaluated in the same manner as for the two-component developer No. 1 in Example 1. The results of the evaluation are shown in TABLE 2.

EXAMPLE 5

The following components were sufficiently mixed in a mixer.

| | Parts by Weight |
|---|---|
| Binder resin: polyester resin (Flow initiation temperature: 125° C.) | 100 |
| Coloring agent: carbon black | 10 |
| Charge control agent: zinc salicylate | 3 |
| Releasing agent: low-molecular-weight polyethylene (Melting point: 90° C., Melt viscosity: 0.06 Pa · s (at 125° C.), DSC endothermic peak temperature: 85° C. to 90° C.) | 3 |
| Approximate SP value difference between the binder resin and the releasing agent: 1.3 to 1.7 | |

The resultant mixture was fused and kneaded in the TEM type double screw extruder made by Toshiba Machine Co., Ltd., in such a manner that the specific energy at the time of kneading was set at 0.16 kWH/kg with the adjustment of the temperature of the extruder and the amount of the mixture to be kneaded, whereby a kneaded mixture (3) was obtained.

The kneaded mixture (3) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 10.6% in terms of the percentage of the number of the colored matrix particles, and had a weight-average particle diameter of 7.67 μm.

100 parts by weight of the colored matrix particles were mixed with 0.3 parts by weight of hydrophobic silica particles in a Henschel mixer, whereby a toner (5A) of the present invention was obtained.

The toner (5A) was then subjected to coarse classification, whereby a toner (52) with a weight-average particle diameter of 4 μm was obtained.

The ratio of the endotherm of the releasing agent contained in the toner (5A) to the endotherm of the releasing agent contained in the toner (5B) by the DSC measurement.

The result was that the endotherm ratio (Q/q) of the releasing agent was 0.901, that is, Q/q=0.901.

In order to evaluate the fluidity of the toner (5A), the loose bulk density and the aggregation ratio of the toner (5A) were measured in the same manner as in Example 1. The results are shown in TABLE 2.

Preparation of Two-Component Developer No. 5

2.5 parts by weight of the toner (5A) were mixed with 97.5 parts by weight of a carrier prepared by coating ferrite particles having an average particle diameter of 60 μm with a silicone resin, whereby a two-component developer No. 5 according to the present invention was prepared.

The thus obtained two-component developer No. 5 was evaluated in the same manner as for the two-component developer No. 1 in Example 1. The results of the evaluation are shown in TABLE 2.

EXAMPLE 6

The following components were sufficiently mixed in a mixer.

| | Parts by Weight |
|---|---|
| Binder resin: polyester resin (Flow initiation temperature: 127° C.) | 100 |
| Coloring agent: carbon black | 10 |
| Charge control agent: zinc salicylate | 3 |
| Releasing agent: low-molecular-weight polyethylene (Melting point: 90° C., Melt viscosity: 0.06 Pa · s (at 125° C.), DSC endothermic peak temperature: 85° C. to 90° C.) | 3 |
| Approximate SP value difference between the binder resin and the releasing agent: 2.6 to 3.0 | |

The resultant mixture was fused and kneaded in the TEM type double screw extruder made by Toshiba Machine Co., Ltd., in such a manner that the specific energy at the time of kneading was set at 0.15 kWH/kg with the adjustment of the temperature of the extruder and the amount of the mixture to be kneaded, whereby a kneaded mixture (4) was obtained.

The kneaded mixture (4) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 6.8% in terms of the percentage of the number of the colored matrix particles, and had a weight-average particle diameter of 9.53 μm.

100 parts by weight of the colored matrix particles were mixed with 0.3 parts by weight of hydrophobic silica particles in a Henschel mixer, whereby a toner (6A) of the present invention was obtained.

The toner (6A) was then subjected to coarse classification, whereby a toner (6B) with a weight-average particle diameter of 4 μm was obtained.

The ratio of the endotherm of the releasing agent contained in the toner (6A) to the endotherm of the releasing agent contained in the toner (6B) by the DSC measurement.

The result was that the endotherm ratio (Q/q) of the releasing agent was 0.781, that is, Q/q=0.781.

In order to evaluate the fluidity of the toner (6A), the loose bulk density and the aggregation ratio of the toner (6A) were measured in the same manner as in Example 1. The results are shown in TABLE 2.

Preparation of Two-Component Developer No. 6

2.5parts by weight of the toner (6A) were mixed with 97.5 parts by weight of a carrier prepared by coating ferrite particles having an average particle diameter of 60 μm with a silicone resin, whereby a two-component developer No. 6 according to the present invention was prepared.

The thus obtained two-component developer No. 6 was evaluated in the same manner as for the two-component developer No. 1 in Example 1. The results of the evaluation are shown in TABLE 2.

EXAMPLE 7

The following components were sufficiently mixed in a mixer.

| | Parts by Weight |
|---|---|
| Binder resin: polyester resin (Flow initiation temperature: 125° C.) | 100 |
| Coloring agent: carbon black | 10 |
| Charge control agent: zinc salicylate | 3 |
| Releasing agent: low-molecular-weight polyethylene (Melting point: 88° C., Melt viscosity: 0.06 Pa · s (at 125° C.), DSC endothermic peak temperature: 85° C. to 90° C.) | 3 |
| Approximate SP value difference between the binder resin and the releasing agent: 2.0 to 2.4 | |

The resultant mixture was fused and kneaded in the TEM type double screw extruder made by Toshiba Machine Co., Ltd., in such a manner that the specific energy at the time of kneading was set at 0.21 kWH/kg with the adjustment of the temperature of the extruder and the amount of the mixture to be kneaded, whereby a kneaded mixture (5) was obtained.

The kneaded mixture (5) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 7.4% in terms of the percentage of the number of the colored matrix particles, and had a weight-average particle diameter of 10.02 μm.

100 parts by weight of the colored matrix particles were mixed with 0.3 parts by weight of hydrophobic silica particles in a Henschel mixer, whereby a toner (7A) of the present invention was obtained.

The toner (7A) was then subjected to coarse classification, whereby a toner (7B) with a weight-average particle diameter of 4 μm was obtained.

The ratio of the endotherm of the releasing agent contained in the toner (7A) to the endotherm of the releasing agent contained in the toner (7B) by the DSC measurement.

The result was that the endotherm ratio (Q/q) of the releasing agent was 0.833, that is, Q/q=0.833.

In order to evaluate the fluidity of the toner (7A), the loose bulk density and the aggregation ratio of the toner (7A) were measured in the same manner as in Example 1. The results are shown in TABLE 2.

Preparation of Two-Component Developer No. 7

2.5 parts by weight of the toner (7A) were mixed with 97.5 parts by weight of a carrier prepared by coating ferrite particles having an average particle diameter of 60 μm with a silicone resin, whereby a two-component developer No. 7 according to the present invention was prepared.

The thus obtained two-component developer No. 7 was evaluated in the same manner as for the two-component developer No. 1 in Example 1. The results of the evaluation are shown in TABLE 2.

EXAMPLE 8

The following components were sufficiently mixed in a mixer.

| | Parts by Weight |
|---|---|
| Binder resin: polyol resin (Flow initiation temperature: 120° C.) | 100 |
| Coloring agent: carbon black | 10 |
| Charge control agent: zinc salicylate | 3 |
| Releasing agent: Carnauba wax (Melting point: 82° C., Melt viscosity: 0.05 Pa · s (at 120° C.), DSC endothermic peak temperature: 78° C. to 85° C.) | 3 |
| Approximate SP value difference between the binder resin and the releasing agent: 1.6 to 2.0 | |

The resultant mixture was fused and kneaded in the Continuous Kneader made by Buss Co., Ltd, in such a manner that the specific energy at the time of kneading was set at 0.21 kWH/kg with the adjustment of the temperature of the extruder and the amount of the mixture to be kneaded, whereby a kneaded mixture (6) was obtained.

The kneaded mixture (6) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 16.0% in terms of the percentage of the number of the colored matrix particles, and had a weight-average particle diameter of 7.48 μm.

100 parts by weight of the colored matrix particles were mixed with 0.3 parts by weight of hydrophobic silica particles in a Henschel mixer, whereby a toner (8A) of the present invention was obtained.

The toner (8A) was then subjected to coarse classification, whereby a toner (8B) with a weight-average particle diameter of 4 μm was obtained.

The ratio of the endotherm of the releasing agent contained in the toner (8A) to the endotherm of the releasing agent contained in the toner (8B) by the DSC measurement.

The result was that the endotherm ratio (Q/q) of the releasing agent was 0.909, that is, Q/q=0.909.

In order to evaluate the fluidity of the toner (8A), the loose bulk density and the aggregation ratio of the toner (8A) were measured in the same manner as in Example 1. The results are shown in TABLE 2.

Preparation of Two-Component Developer No. 8

2.5 parts by weight of the toner (8A) were mixed with 97.5 parts by weight of a carrier prepared by coating ferrite particles having an average particle diameter of 60 μm with a silicone resin, whereby a two-component developer No. 8 according to the present invention was prepared.

The thus obtained two-component developer No. 8 was evaluated in the same manner as for the two-component developer No. 1 in Example 1. The results of the evaluation are shown in TABLE 2.

COMPARATIVE EXAMPLE 1

A kneaded mixture (7) was prepared in the same manner as for the kneaded mixture (1) prepared in Example 1 except that the specific energy at the time of kneading was set at 0.09 kWH/kg by elevating the temperature of the extruder and increasing the amount of the mixture to be kneaded.

The kneaded mixture (7) was rolled and cooled, and then coarsely crushed by a cutter mill and finely pulverized by means of a pulverizer using jet air stream.

The pulverized mixture was then subjected to air classification, using a rotary air classifier, whereby there were obtained such colored matrix particles that contained therein colored particles with a particle diameter of 4 μm or less in an amount of 15.3% in terms of the percentage of the number of the colored matrix particles, and had a weight-average particle diameter of 7.55 μm.

100 parts by weight of the colored matrix particles were mixed with 0.3 parts by weight of hydrophobic silica particles in a Henschel mixer, whereby a toner (9A) was obtained.

The toner (9A) was then subjected to coarse classification, whereby a toner (9B) with a weight-average particle diameter of 4 μm was obtained.

The ratio of the endotherm of the releasing agent contained in the toner (9A) to the endotherm of the releasing agent contained in the toner (9B) by the DSC measurement.

The result was that the endotherm ratio (Q/q) of the releasing agent was 0.758, that is, Q/q=0.758.

In order to evaluate the fluidity of the toner (9A), the loose bulk density and the aggregation ratio of the toner (9A) were measured in the same manner as in Example 1. The results are shown in TABLE 2.

Preparation of Comparative Two-Component Developer No. 1

2.5 parts by weight of the toner (9A) were mixed with 97.5 parts by weight of a carrier prepared by coating ferrite particles having an average particle diameter of 60 μm with a silicone resin, whereby a comparative two-component developer No. 1 was prepared.

The thus obtained comparative two-component developer No. 1 was evaluated in the same manner as for the two-component developer No. 1 in Example 1. The results of the evaluation are shown in TABLE 2.

COMPARATIVE EXAMPLE 2

A kneaded mixture (8) was prepared in the same manner as for the kneaded mixture (4) prepared in Example 6 except that the specific energy at the time of kneading was set at 0.08 kWH/kg by elevating the temperature of the extruder and increasing the amount of the mixture to be kneaded.

The kneaded mixture (8) was rolled and cooled, and then coarsely crushed by a cutter mill and finely pulverized by means of a pulverizer using jet air stream.

The pulverized mixture was then subjected to air classification, using a rotary air classifier, whereby there were obtained such colored matrix particles that contained therein colored particles with a particle diameter of 4 μm or less in an amount of 7.2% in terms of the percentage of the number of the colored matrix particles, and had a weight-average particle diameter of 10.11 μm.

100 parts by weight of the colored matrix particles were mixed with 0.3 parts by weight of hydrophobic silica particles in a Henschel mixer, whereby a toner (10A) was obtained.

The toner (10A) was then subjected to coarse classification, whereby a toner (10B) with a weight-average particle diameter of 4 μm was obtained.

The ratio of the endotherm of the releasing agent contained in the toner (10A) to the endotherm of the releasing agent contained in the toner (10B) by the DSC measurement.

The result was that the endotherm ratio (Q/q) of the releasing agent was 0.752, that is, Q/q 0.752.

In order to evaluate the fluidity of the toner (10A), the loose bulk density and the aggregation ratio of the toner (10A) were measured in the same manner as in Example 1. The results are shown in TABLE 2.

The toner (10A) was further subjected to coarse classification, whereby a toner (10C) with a weight-average particle diameter of 7.1 μm was obtained.

The ratio of the endotherm of the releasing agent contained in the toner (10A) to the endotherm of the releasing agent contained in the toner (10C) by the DSC measurement.

The result was that the endotherm ratio (Q/q) of the releasing agent was 0.847, that is, Q/q=0.847.

Preparation of Comparative Two-Component Developer No. 2

2.5 parts by weight of the toner (10A) were mixed with 97.5 parts by weight of a carrier prepared by coating ferrite particles having an average particle diameter of 60 μm with a silicone resin, whereby a comparative two-component developer No. 2 was prepared.

The thus obtained comparative two-component developer No. 2 was evaluated in the same manner as for the two-component developer No. 1 in Example 1. The results of the evaluation are shown in TABLE 2.

COMPARATIVE EXAMPLE 3

A kneaded mixture (9) was prepared in the same manner as for the kneaded mixture (4) prepared in Example 6 except that the specific energy at the time of kneading was set at 0.11 kWH/kg by adjusting the temperature of the extruder and the amount of the mixture to be kneaded.

The kneaded mixture (9) was rolled and cooled, and then coarsely crushed by a cutter mill and finely pulverized by means of a pulverizer using jet air stream.

The pulverized mixture was then subjected to air classification, using a rotary air classifier, whereby there were obtained such colored matrix particles that contained therein colored particles with a particle diameter of 4 μm or less in an amount of 5.5% in terms of the percentage of the number of the colored matrix particles, and had a weight-average particle diameter of 12.50 μm.

100 parts by weight of the colored matrix particles were mixed with 0.3 parts by weight of hydrophobic silica particles in a Henschel mixer, whereby a toner (11A) was obtained.

The toner (11A) was then subjected to coarse classification, whereby a toner (11B) with a weight-average particle diameter of 4 μm was obtained.

The ratio of the endotherm of the releasing agent contained in the toner (11A) to the endotherm of the releasing agent contained in the toner (11B) by the DSC measurement.

The result was that the endotherm ratio (Q/q) of the releasing agent was 0.781, that is, Q/q=0.781.

In order to evaluate the fluidity of the toner (11A), the loose bulk density and the aggregation ratio of the toner (11A) were measured in the same manner as in Example 1. The results are shown in TABLE 2.

Preparation of Comparative Two-Component Developer No. 2

2.5 parts by weight of the toner (11A) were mixed with 97.5 parts by weight of a carrier prepared by coating ferrite particles having an average particle diameter of 60 μm with a silicone resin, whereby a comparative two-component developer No. 3 was prepared.

The thus obtained comparative two-component developer No. 3 was evaluated in the same manner as for the two-component developer No. 1 in Example 1. The results of the evaluation are shown in TABLE 2.

COMPARATIVE EXAMPLE 4

The procedure for producing the toner (1A) in Example 1 was repeated in the same manner as in Example 1 except that the pulverized mixture for use in the toner (1A) was subjected to air classification, using the rotary air classifier in such a manner that there were obtained such colored matrix particles that contained therein colored particles with a particle diameter of 4 μm or less in an amount of 10.1% in terms of the percentage of the number of the colored matrix particles, and had a weight-average particle diameter of 4.8 μm, by changing the classifying conditions, whereby a toner (12A) was prepared.

In order to obtain the toner (12A) with a weight-average particle diameter of 4.8 μm, the amount of the kneaded material to be pulverized had to be reduced to a half, and at the step of classifying the pulverized material, the yield of the toner (12A) had to be restricted to about 50%, with an extremely poor productivity of the toner (12A).

The toner (12A) was then subjected to coarse classification, whereby a toner (12B) with a weight-average particle diameter of 4 μm was obtained.

The ratio of the endotherm of the releasing agent contained in the toner (12A) to the endotherm of the releasing agent contained in the toner (12B) by the DSC measurement.

The result was that the endotherm ratio (Q/q) of the releasing agent was 0.952, that is, Q/q=0.952.

In order to evaluate the fluidity of the toner (12A), the loose bulk density and the aggregation ratio of the toner (12A) were measured in the same manner as in Example 1. The results are shown in TABLE 2.

Preparation of Comparative Two-Component Developer No. 4

2.5 parts by weight of the toner (12A) were mixed with 97.5 parts by weight of a carrier prepared by coating ferrite particles having an average particle diameter of 60 μm with a silicone resin, whereby a two-component developer No. 4 according to the present invention was prepared.

The thus obtained comparative two-component developer No. 4 was evaluated in the same manner as for the two-component developer No. 1 in Example 1. The results of the evaluation are shown in TABLE 2.

COMPARATIVE EXAMPLE 5

The following components were sufficiently mixed in a mixer.

| | Parts by Weight |
|---|---|
| Binder resin: styrene-acrylic resin (Flow initiation temperature: 120° C.) | 100 |
| Coloring agent: carbon black | 10 |
| Charge control agent: zinc salicylate | 3 |
| Releasing agent: Carnauba wax (Melting point: 82° C., Melt viscosity: 0.05 Pa · s (at 120° C.), DSC endothermic peak temperature: 78° C. to 85° C.) | 3 |
| Approximate SP value difference between the binder resin and the releasing agent: 1.0 or less | |

The resultant mixture was fused and kneaded in the Continuous Kneader made by Buss Co. Ltd, in such a manner that the specific energy at the time of kneading was set at 0.20 kWH/kg with the adjustment of the temperature of the extruder and the amount of the mixture to be kneaded, whereby a kneaded mixture (10) was obtained.

The kneaded mixture (10) was rolled and cooled, and then coarsely crushed by a cutter mill and finely pulverized by means of a pulverizer using jet air stream.

The pulverized mixture was then subjected to air classification, using the rotary air classifier, whereby there were obtained such colored matrix particles that contained therein colored particles with a particle diameter of 4 μm or less in an amount of 14.8% in terms of the percentage of the number of the colored matrix particles, and had a weight-average particle diameter of 7.52 μm.

100 parts by weight of the colored matrix particles were mixed with 0.3 parts by weight of hydrophobic silica particles in a Henschel mixer, whereby a toner (13A) was obtained.

The toner (13A) was then subjected to coarse classification, whereby a toner (13B) with a weight-average particle diameter of 4 μm was obtained.

The ratio of the endotherm of the releasing agent contained in the toner (13A) to the endotherm of the releasing agent contained in the toner (13B) by the DSC measurement.

The result was that the endotherm ratio (Q/q) of the releasing agent was 0.990, that is, Q/q=0.990.

In order to evaluate the fluidity of the toner (13A), the loose bulk density and the aggregation ratio of the toner (13A) were measured in the same manner as in Example 1. The results are shown in TABLE 2.

Preparation of Comparative Two-Component Developer No. 5

2.5 parts by weight of the toner (13A) were mixed with 97.5 parts by weight of a carrier prepared by coating ferrite particles having an average particle diameter of 60 μm with a silicone resin, whereby a comparative two-component developer No. 5 was prepared.

The thus prepared comparative two-component developer No. 5 was evaluated in the same manner as for the two-component developer No. 1 in Example 1. The results of the evaluation are shown in TABLE 2.

TABLE 1 summarizes the amount (wt. %) of the releasing agent used, Q/q, the weight-average particle diameter of the toner, the number % of particles with a particle diameter of 4 μm or less, and the specific energy applied at the time of kneading in each of Examples 1 to 8 of the present invention and Comparative Examples 1 to 5.

TABLE 1

| | Amount of releasing agent (wt. %) | Q/q | Weight-average particle diameter (μm) | Number % of particles with a particle diameter of 4 μm or less | Specific energy at the time of kneading kWH/kg |
|---|---|---|---|---|---|
| Ex. 1 | 5 | 0.870 | 7.31 | 22.6 | 0.20 |
| Ex. 2 | 5 | 0.855 | 7.54 | 15.2 | 0.20 |
| Ex. 3 | 5 | 0.833 | 7.72 | 8.3 | 0.20 |
| Ex. 4 | 5 | 0.917 | 7.50 | 8.1 | 0.32 |
| Ex. 5 | 3 | 0.901 | 7.67 | 10.6 | 0.16 |
| Ex. 6 | 8 | 0.781 | 9.53 | 6.8 | 0.15 |
| Ex. 7 | 10 | 0.833 | 10.02 | 7.4 | 0.21 |
| Ex. 8 | 5 | 0.909 | 7.48 | 16 | 0.21 |
| Comp. Ex. 1 | 5 | 0.758 | 7.55 | 15.3 | 0.09 |
| Comp. Ex. 2 | 8 | 0.752 | 10.11 | 7.2 | 0.08 |
| Comp. Ex. 3 | 8 | 0.781 | 12.50 | 5.5 | 0.11 |
| Comp. Ex. 4 | 5 | 0.952 | 4.80 | 40.1 | 0.20 |
| Comp. Ex. 5 | 5 | 0.990 | 7.52 | 14.8 | 0.20 |

TABLE 2

| | Fluidity | | | Durability | | | | |
|---|---|---|---|---|---|---|---|---|
| | Loose density (g/cm$^3$) | Aggregation ratio (%) | Results of evaluation | Initial charge quantity A ($\mu$C/q) | After running test of making 100,000 copies B ($\mu$C/g) | Results of evaluation | Anti-offset performance Results of evaluation | Image quality Rankings for evaluation |
| Ex. 1 | 0.358 | 3.77 | ○ | −24.2 | −23.3 | ◎ | ○ | 5 |
| Ex. 2 | 0.370 | 3.19 | ◎ | −24.1 | −23.3 | ◎ | ○ | 5 |
| Ex. 3 | 0.382 | 3.17 | ◎ | −24.2 | −23.6 | ◎ | ○ | 5 |
| Ex. 4 | 0.396 | 3.06 | ◎ | −24.0 | −23.3 | ◎ | ○ | 5 |
| Ex. 5 | 0.398 | 3.04 | ◎ | −24.4 | −23.4 | ◎ | Δ | 5 |
| Ex. 6 | 0.321 | 3.88 | ○ | −23.9 | −21.8 | Δ | ◎ | 4 |
| Ex. 7 | 0.333 | 3.81 | ○ | −23.8 | −22.2 | ○ | ◎ | 4.5 |
| Ex. 8 | 0.397 | 3.05 | ◎ | −24.3 | −23.7 | ◎ | ○ | 5.0 |
| Comp. Ex. 1 | 0.302 | 6.65 | x | −24.2 | −20.1 | x | ○ | 5 |
| Comp. Ex. 2 | 0.271 | 28.02 | x | −23.8 | −19.7 | x | ◎ | 4 |
| Comp. Ex. 3 | 0.293 | 26.11 | x | −19.7 | −16.1 | x | ◎ | 3 |
| Comp. Ex. 4 | 0.420 | 2.80 | ◎ | −27.6 | −24.8 | Δ | Δ | 5 |
| Comp. Ex. 5 | 0.408 | 2.91 | ◎ | −25.2 | −24.8 | ◎ | x | 5 |

| Results of evaluation | Fluidity (Aggregation ratio) | Durability (A–B) | Anti-offset performance (Offset occurrence temperature) |
|---|---|---|---|
| ◎ | 0–3.5 | 0–1.0 | 200° C. or more |
| ○ | 3.5–4.5 | 1.0–2.0 | 190° C.–200° C. |
| Δ | 4.5–6.5 | 2.0–3.0 | 180° C.–190° C. |
| x | 6.5 or more | 3.0 or more | 180° C. or below |

Japanese Patent Application No. 11-100822 filed Apr. 8, 1999 is hereby incorporated by reference.

What is claimed is:

1. A toner comprising toner particles, each toner particle comprising a binder resin, a coloring agent and a releasing agent, wherein said toner particles have a weight-average particle diameter of 5 to 12 $\mu$m, containing therein toner particles with a particle diameter of 4 $\mu$m or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 $\mu$m from said toner, wherein q is the endotherm ($\mu$V·min/mg) of said releasing agent contained in said sampled toner particles, assessed per unit amount of said sampled toner particles, and Q is the endotherm ($\mu$V·min/mg) of said releasing agent contained in said toner particles of said toner in its entirety, assessed per unit amount of said toner particles.

2. The toner as claimed in claim 1, wherein said releasing agent is in an amount of 3 to 8 wt. % of the entire weight of said toner.

3. The toner as claimed in claim 1, wherein said releasing agent has a melting point of 65° C. to 120° C.

4. The toner as claimed in claim 1, wherein said releasing agent has a maximum endothermic peak in a range of 50° C. to 95° C. in a DSC endothermic curve of said releasing agent.

5. The toner as claimed in claim 1, wherein said releasing agent has a melt viscosity of 0.04 Pa·s to 0.12 Pa·s at a flow initiation temperature of said binder resin.

6. The toner as claimed in claim 1, wherein said releasing agent and said binder resin differ in terms of the value of SP (solubility parameter) thereof by a value of 1.0 to 3.5.

7. The toner as claimed in claim 1, wherein said releasing agent and said binder resin differ in terms of the value of SP (solubility parameter) thereof by a value of 1.3 to 2.7.

8. The toner as claimed in claim 1, wherein said releasing agent comprises carnauba wax.

9. The toner as claimed in claim 1, wherein said binder resin comprises a resin selected from the group consisting of a polyester resin with a SP value of 11.0 or less and a polyol resin with a SP value of 11.0 or less.

10. The toner as claimed in claim 1, further comprising a carrier, thereby constituting a two-component type toner.

11. A toner container containing therein a toner with a packing density of 0.45 g/cm$^3$, said toner comprising toner particles, each toner particle comprising a binder resin, a coloring agent and a releasing agent, wherein said toner particles have a weight-average particle diameter of 5 to 12 $\mu$m, containing therein toner particles with a particle diameter of 4 $\mu$m or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 $\mu$m from said toner, wherein q is the endotherm ($\mu$V·min/mg) of said releasing agent contained in said sampled toner particles, assessed per unit amount of said sampled toner particles, and Q is the endotherm ($\mu$V·min/mg) of said releasing agent contained in said toner particles of said toner in its entirety, assessed per unit amount of said toner particles.

12. A toner cartridge comprising a toner container portion and a development portion, containing therein a toner comprising toner particles, each toner particle comprising a binder resin, a coloring agent and a releasing agent, wherein said toner particles have a weight-average particle diameter of 5 to 12 $\mu$m, containing therein toner particles with a particle diameter of 4 $\mu$m or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

13. An image formation method for forming a toner image, comprising the steps of:

forming a latent electrostatic image on a latent electrostatic image bearing member, developing said latent electrostatic image with a toner to form a toner image on said latent electrostatic image bearing member, transferring said toner image from said latent electrostatic image bearing member to an image transfer sheet, and fixing said toner image to said image transfer sheet, using a contact type heat application roller free of oil application function, wherein said toner comprises toner particles, each toner particle comprising a binder resin, a coloring agent and a releasing agent, wherein said toner particles have a weight-average particle diameter of 5 to 12 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

14. A method for producing a toner which comprises toner particles, each toner particle comprising a binder resin, a coloring agent and a releasing agent, wherein said toner particles have a weight-average particle diameter of 5 to 12 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles, comprising the steps of:

mixing said binder resin, said coloring agent and said releasing agent, each in a powder state, fusing and kneading said binder resin, said coloring agent, and said releasing agent to prepare a kneaded material, pulverizing said kneaded material to prepare a pulverized material, and classifying said pulverized material to prepare said toner with a predetermined particle size distribution, wherein the temperature of said kneaded material at an outlet therefor in said fusing and kneading step is set at a temperature in a range of the melting point of said releasing agent to the temperature of 30° C. or less above a flow initiation temperature of said binder resin, and a specific energy of 0.1 kWH/kg or more is applied to said kneaded material.

15. A method for producing a toner which comprises toner particles, each toner particle comprising a binder resin, a coloring agent and a releasing agent, wherein said toner particles have a weight-average particle diameter of 5 to 12 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.77, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles, comprising the steps of:

mixing said binder resin, said coloring agent and said releasing agent, each in a powder state, fusing and kneading said binder resin, said coloring agent, and said releasing agent to prepare a kneaded material, pulverizing said kneaded material to prepare a pulverized material, and classifying said pulverized material to prepare said toner with a predetermined particle size distribution, wherein the temperature of said kneaded material at an outlet therefor in said fusing and kneading step is set at a temperature in a range of the melting point of said releasing agent to the temperature of 20° C. or less above a flow initiation temperature of said binder resin, and a specific energy of 0.2 kWH/kg or more is applied to said kneaded material.

16. A toner comprising toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

17. The toner as claimed in claim 16, wherein said releasing agent is in an amount of 3 to 8 wt. % of the entire weight of said toner.

18. The toner as claimed in claim 16, wherein said releasing agent has a melting point of 65° C. to 120° C.

19. The toner as claimed in claim 16, wherein said releasing agent has a maximum endothermic peak in a range of 50° C. to 95° C. in a DSC endothermic curve of said releasing agent.

20. The toner as claimed in claim 16, wherein said releasing agent has a melt viscosity of 0.04 Pa·s to 0.12 Pa·s at a flow initiation temperature of said binder resin.

21. The toner as claimed in claim 16, wherein said releasing agent and said binder resin differ in terms of the value of SP (solubility parameter) thereof by a value of 1.0 to 3.5.

22. The toner as claimed in claim 16, wherein said releasing agent and said binder resin differ in terms of the value of SP (solubility parameter) thereof by a value of 1.3 to 2.7.

23. The toner as claimed in claim 16, wherein said releasing agent comprises carnauba wax.

24. The toner as claimed in claim 16, wherein said binder resin comprises a resin selected from the group consisting of a polyester resin with a SP value of 11.0 or less and a polyol resin with a SP value of 11.0 or less.

25. The toner as claimed in claim 16, further comprising a carrier, thereby constituting a two-component type toner.

26. A toner container containing therein a toner with a packing density of 0.45 g/cm$^3$, said toner comprising toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

27. A toner cartridge comprising a toner container portion and a development portion, containing therein a toner comprising toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

28. An image formation method for forming a toner image, comprising the steps of:

forming a latent electrostatic image on a latent electrostatic image bearing member, developing said latent electrostatic image with a toner to form a toner image on said latent electrostatic image bearing member, transferring said toner image from said latent electrostatic image bearing member to an image transfer sheet, and fixing said toner image to said image transfer sheet, using a contact type heat application roller free of oil application function, wherein said toner comprises toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles.

29. A method for producing a toner which comprises toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles, comprising the steps of:

mixing said binder resin, said coloring agent and said releasing agent, each in a powder state, fusing and kneading said binder resin, said coloring agent, and said releasing agent to prepare a kneaded material, pulverizing said kneaded material to prepare a pulverized material, and classifying said pulverized material to prepare said toner with a predetermined particle size distribution, wherein the temperature of said kneaded material at an outlet therefor in said fusing and kneading step is set at a temperature in a range of the melting point of said releasing agent to the temperature of 30° C. or less above a flow initiation temperature of said binder resin, and a specific energy of 0.1 kWH/kg or more is applied to said kneaded material.

30. A method for producing a toner which comprises toner particles, each toner particle comprising a binder resin, a coloring agent and a releasing agent, wherein said toner particles have a weight-average particle diameter of 5 to 8 μm, containing therein toner particles with a particle diameter of 4 μm or less in an amount of 35% or less in terms of the percentage of the number of toner particles in said toner particles, and said releasing agent has an endotherm ratio (Q/q) of 0.98 to 0.83, that is measured, using a differential scanning calorimeter (DSC), by classifying and sampling toner particles with a weight-average particle diameter of 4 μm from said toner, wherein q is the endotherm (μV·min/mg) of said releasing agent contained in said sampled toner particles, assessed per unit amount of said sampled toner particles, and Q is the endotherm (μV·min/mg) of said releasing agent contained in said toner particles of said toner in its entirety, assessed per unit amount of said toner particles, comprising the steps of:

mixing said binder resin, said coloring agent and said releasing agent, each in a powder state, fusing and kneading said binder resin, said coloring agent, and said releasing agent to prepare a kneaded material, pulverizing said kneaded material to prepare a pulverized material, and classifying said pulverized material to prepare said toner with a predetermined particle size distribution, wherein the temperature of said kneaded material at an outlet therefor in said fusing and kneading step is set at a temperature in a range of the melting point of said releasing agent to the temperature of 20° C. or less above a flow initiation temperature of said binder resin, and a specific energy of 0.2 kWH/kg or more is applied to said kneaded material.

* * * * *